US011713857B1

(12) United States Patent
Darlage et al.

(10) Patent No.: US 11,713,857 B1
(45) Date of Patent: Aug. 1, 2023

(54) BI-DIRECTIONAL LIGHT SYSTEM

(71) Applicant: Valeo North America, Inc., Troy, MI (US)

(72) Inventors: Colby Darlage, Troy, MI (US); Brant Potter, Troy, MI (US); David Egly, Troy, MI (US)

(73) Assignee: Valeo Vision, Bobigny (FR)

( * ) Notice: Subject to any disclaimer, the term of this patent is extended or adjusted under 35 U.S.C. 154(b) by 0 days.

(21) Appl. No.: 17/868,354

(22) Filed: Jul. 19, 2022

Related U.S. Application Data

(60) Provisional application No. 63/334,784, filed on Apr. 26, 2022.

(51) Int. Cl.
*F21S 41/20* (2018.01)
*F21S 41/24* (2018.01)
*F21W 103/55* (2018.01)

(52) U.S. Cl.
CPC ..... *F21S 41/24* (2018.01); *F21S 41/28* (2018.01); *F21W 2103/55* (2018.01)

(58) Field of Classification Search
CPC ..... F21S 41/24; F21S 41/285; F21S 43/243; F21S 43/245; F21S 41/148; F21S 41/147; B60Q 1/2665; B60Q 1/381; B60Q 2400/40; B60Q 1/18; B60Q 1/245; B60Q 1/247; F21W 2107/10; F21W 2111/00; F21W 2121/00; G02B 6/0035; G02B 6/0036; G02B 30/33; B60R 1/06; B60R 1/1207; F21Y 2105/00
See application file for complete search history.

(56) References Cited

U.S. PATENT DOCUMENTS

| | | | | |
|---|---|---|---|---|
| 9,360,183 | B2 * | 6/2016 | Ichikawa | B60Q 1/2665 |
| 2002/0057575 | A1 * | 5/2002 | Schwanz | F21S 43/247 362/487 |
| 2004/0190303 | A1 * | 9/2004 | Mishimagi | B60Q 1/2665 362/494 |
| 2006/0146555 | A1 * | 7/2006 | Inaba | F21S 43/239 340/475 |
| 2009/0051523 | A1 | 2/2009 | Perkins | |
| 2010/0327747 | A1 | 12/2010 | Harris | |
| 2012/0081915 | A1 * | 4/2012 | Foote | B60Q 1/38 362/494 |
| 2013/0242586 | A1 * | 9/2013 | Huizen | F21S 43/249 362/494 |

FOREIGN PATENT DOCUMENTS

WO 201205412 A1 1/2012

* cited by examiner

*Primary Examiner* — Omar Rojas Cadima
(74) *Attorney, Agent, or Firm* — Young Basile Hanlon & MacFarlane, P.C.

(57) ABSTRACT

A light system comprising: a light blade comprising: a first surface and a second surface; a bi-directional light system configured to direct first lights into the light blade so that the first lights extend out of the first surface of the light blade to generate a first light direction, and the bi-directional light system is configured to direct second lights into the light blade so that the second lights extend out of the second surface of the light blade to generate a second light direction; and wherein the first surface and the second surface are substantially perpendicular to one another.

20 Claims, 5 Drawing Sheets

BI-DIRECTIONAL LIGHT SYSTEM

CROSS-REFERENCE TO RELATED APPLICATION(S)

This application claims priority to and the benefit of U.S. Provisional Patent Application Ser. No. 63/334,784, filed Apr. 26, 2022, the entire disclosure of which is hereby incorporated by reference.

FIELD

The present teachings relate to a light system that provides light in two or more directions and the light is configured to illuminate such that the light in the two or more directions appears to be moving.

BACKGROUND

Vehicles include many different types of lights. Some types of lights included on a vehicle are low beam headlights, high beam headlights, taillights, turn signal lights, fog lights, running lights, or a combination thereof. Each of these lights extend out of an outer surface of a vehicle so that they provide light for the driver or provide notice to surrounding drivers. These light systems generally direct light outward from the vehicle.

Examples of light systems may be disclosed in U.S. Patent Application Publication Nos. 2009/0051523 and 2010/0327747 and International Patent Application No. WO2012005412 all of which are expressly incorporated herein by reference for all purposes. Thus, there is a need for a light system where lights are illuminated in two or more directions. There is a need for a system where a single lens is illuminated in two planes. There is a need for a system where a light is animated in two different directions in series or simultaneously. It would be desirable to have a light system where multiple different light colors are extendable through a single lens in multiple directions.

SUMMARY

The present teachings provide: a light system comprising: a light blade comprising: a first surface and a second surface; a bi-directional light system configured to direct first lights into the light blade so that the first lights extend out of the first surface of the light blade to generate a first light direction, and the bi-directional light system is configured to direct second lights into the light blade so that the second lights extend out of the second surface of the light blade to generate a second light direction; and wherein the first surface and the second surface are substantially perpendicular to one another.

The present teachings provide a light system comprising: a controller and a light blade comprising: a first surface and a second surface; a bi-directional light system configured to direct first lights into the light blade so that the first lights extend out of the first surface of the light blade to generate a first light direction, and the bi-directional light system is configured to direct second lights into the light blade so that the second lights extend out of the second surface of the light blade to generate a second light direction; and wherein the first surface and the second surface are adjacent; and wherein the controller controls the bi-directional light system to illuminate individual lights of the bi-directional light system through the light blade.

The present teachings provide a light system where two or more lighting functions are incorporated adjacent to one another and one lighting function may operate without any light being visible through the adjacent lighting functions. The present teachings provide a system where light is prevented from bleeding though a texture shutoff region without extending through a textured region. The present teachings provide a system where each portion of the light system are visibly separate so that light from one does not illuminate another. The present teachings provide a light system comprising a texture shutoff that prevents flash during the manufacturing and does not emit light without the light passing through a textured portion.

DETAILED DESCRIPTION

Figure 1A:
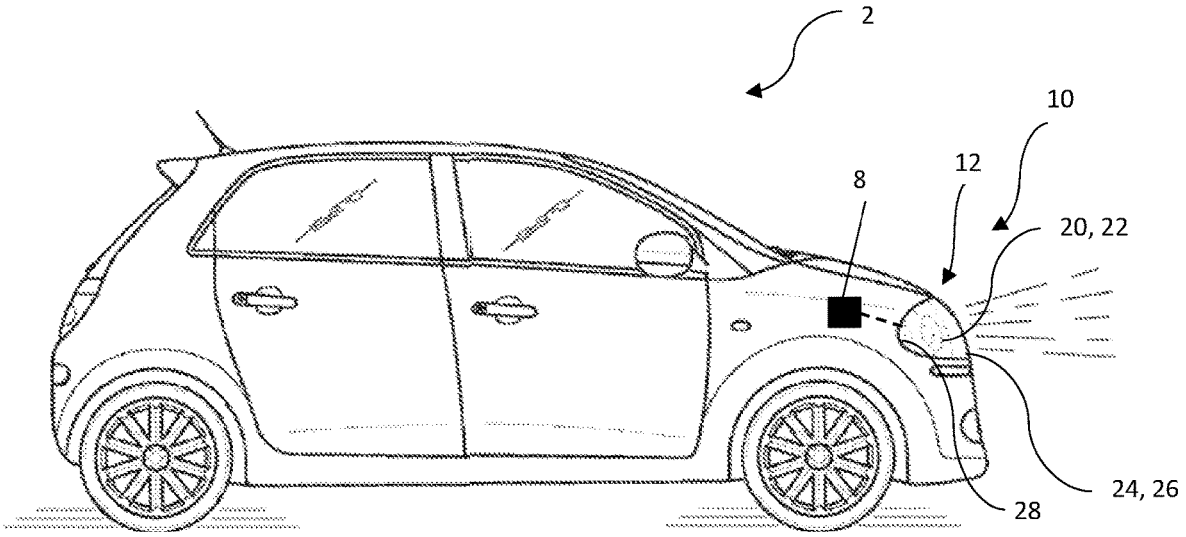
FIG. 1A is a side view of a vehicle including a light system.

The explanations and illustrations presented herein are intended to acquaint others skilled in the art with the invention, its principles, and its practical application. Those skilled in the art may adapt and apply the invention in its numerous forms, as may be best suited to the requirements of a particular use. Accordingly, the specific embodiments of the present invention as set forth are not intended as being exhaustive or limiting of the teachings. The scope of the teachings should, therefore, be determined not with reference to the above description, but should instead be determined with reference to the appended claims, along with the full scope of equivalents to which such claims are entitled. The disclosures of all articles and references, including patent applications and publications, are incorporated by reference for all purposes. Other combinations are also possible as will be gleaned from the following claims, which are also hereby incorporated by reference into this written description.

The present teachings relate to a light system. The light system is located within a vehicle. Preferably, the light system is part of a vehicle such as a car, motorcycle, bus, truck, semi-truck, SUV, XUV, four-wheeler, dirt bike, tractor, combine, heavy equipment, farm equipment, industrial equipment, commercial equipment, or a combination thereof. The light system may project light in a forward direction, rear direction, side direction, vertical direction (e.g., z-axis), from a fore to an aft, an aft to a fore, or a combination thereof. The fore may be a forward direction of a vehicle or a front. The aft may be a rear direction of a vehicle or a rear. Preferably, the light system projects a light from an external surface of the vehicle to a location in front of the vehicle or at an angle relative to the front or rear of a vehicle. The light system may direct some light at the ground. The light system may direct some light above the ground. The light system may be integrated into a front end, a rear end, or both of a car. The light system may be an assembly. The light system may be a sealed light system that is integrated into a vehicle. The light system may be a sub-assembly that is included in a larger light system. The light system may be integrated into another light system and may function to be part of the light system. The light system may project light out of the vehicle. The light systems may be multiple light systems or light sources stacked one above the other, side by side, within different planes, within a same plane and projecting in different direction, integrated into a single light system, or a combination thereof. The light system may have multiple smaller light systems or light sources. The plurality of light systems or lights may be located in one light system. The plurality of light systems may operate independently of one another such that one light system may not affect another light system or portion of the light system. The light of the vehicle may be two or more, three or more, or four or more light systems located adjacent one another. The light system may be or include one or more bi-directional light systems.

The bi-directional light system functions to project light in at least two directions or two planes. The bi-directional light system functions to direct light though a light blade in two or more directions. The bi-directional light system may provide two lights that are perpendicular or substantially perpendicular to one another. The bi-directional light system may provide a single light function. The bi-directional light system may provide light from a plurality of light sources in two directions simultaneously. The light extending in the two directions may extend at an angle relative to one another. The angle may be about 15 degrees or more, about 30 degrees or more, about 45 degrees or more, about 60 degrees or more, about 75 degrees or more, or about 90 degrees or more. The angle may be about 180 or less, about 175 degrees or less, about 160 degrees or less, about 145 degrees or less, about 115 degrees or less (e.g., about 90 degrees). The light sources and the light direction may be coplanar (e.g., the light blade does not reflect, refract, bend, or a combination thereof) the light from the light source.

The light sources function to produce light. The light source may be a device or a plurality of devices that create light and the light extends outward from the light source. The light source may produce a high beam, a low beam, a blending beam, a running light, a day time light, a turn signal, a brake light, or a combination thereof. The light sources may have different functions. For example, one light source may provide a running light and another light source may be a turn signal. Preferably, a first light source and a second light source combine together to provide a single light function. The light source may comprise a plurality of lights or may be a single light source within a set of light sources. The plurality of lights may be in one set or group of light sources. The plurality of lights may be located in rows, columns, a matrix, or a combination thereof. The light source may be a single light that projects light. In another example, a light source may direct light in a first direction and a second light source may direct light in a second direction that is different from the first direction. The first light from a first light source and the second light from a second light source may extend in different directions but may be visibly combined to provide a light function. The first direction may be along a z-axis within a coordinate system. The second direction may be along an x-axis within a coordinate system. The light source may include a laser diode, glowing phosphor, filament bulb, a light emitting diode, a halogenated light, a xenon light, or a combination thereof. One light source may produce one light function and a second light source may produce a second light function. One light system (e.g., a bi-directional light system) may include a plurality of light sources (e.g., two or more) that produce one light function. The light system may perform only a single light function. The light system may perform two or more light functions. The light system may include a bi-directional light system and another light function such that that the light system provides two or more light functions.

The first light function and the second light function may be different functions. The first light function and the second light function may operate at the same time. The first light function and the second light function may operate at different times. The first light function and the second light function may be optically isolated. The first light function and the second light function may be mechanically connected. The first light function and the second light function may be located on a same side of a vehicle or adjacent sides of a vehicle. The first light function and the second light function may both be located in a front of a vehicle or in a rear of a vehicle. The first light function and the second light function may provide different colored lights. The system may be located in corners of the vehicle (e.g., drivers side front and passenger side front). The first light function may be a daytime running light. The second light function may be a turn signal. Each of the light functions may include independent light sources. The first light function and the second light function may extend through a same lens, a single lens, or multiple lenses. The first light function may by provided first light sources and the second light function may be provided by second light sources.

The light sources may be any type of lighting device that produces light such as an incandescent bulb, fluorescent light, compact fluorescent lamp, halogen lamp, light emitting diode (LED), high intensity discharge lamps (HID); halogen lights, xenon lights, a laser diode, phosphorous bulb, or a combination thereof. The light sources may be a single lamp or bulb. Preferably, the light sources are part of a set of light sources that includes a plurality of lamps, bulbs, diodes, or a combination thereof. The light sources may be part of a set of light sources that includes 2 or more, 3 or more, 4 or more, 5 more, 7 or more, 9 or more, or 11 or more light sources that produce light and combine together to form the light extending from the light system. The sets of light sources may include 20 or less, 18 or less, 16 or less, or 14 or less devices that produce light (e.g., each set may include 8 light sources or alternatively all of the sets when combined together may include 8 light sources or 2 light sources). For example, the set of light sources may be the contents of a single printed circuit board that perform a same lighting function and the set of light sources may be 8 light sources that are all located on the single printed circuit board. The set of light sources may be two or more groups of lights that are located on different printed circuit boards. The printed circuit boards may be located adjacent to one another or spaced apart from one another. The number of light sources in a part of the light may dependent upon a size of the region or a size illuminated. For example, a day time running light may have eight or more light sources and a turn signal may have five or more light sources. In another, example, the day time running light may include two or more groups of light sources that are spaced apart from one another such that when the two or more groups of light sources are on they combine to provide the first light function.

The light source may be one or more lights, two or more lights, or three or more lights. The light source may be static. The light sources may be free of movement. The light source may be fixed. The light sources may be a row of lights, a column of lights, a matrix of lights extending in rows and columns, or a combination thereof. For example, a matrix may have lights that are set out to be 2×2 or more, 3×3 or more, 4×4 or more, 5×5 or more, 6×6 or more, 7×7 or more, 8×8 or more, 9×9 or more, 10×10 or more. The matrix may be 100×100 or less, 75×75 or less, 50×50 or less, 25×25 or less, or even 15×15 or less. The matrix may be made up of a single printed circuit board. The matrix may be a plurality of printed circuit boards that are located proximate to one another to form the matrix. For example, five or more printed circuit boards may be located side by side and each printed circuit board may have a plurality of light sources that extends in two columns of 10 so that the combination of five printed circuit boards form a 10×10 matrix. The light sources may be static and may be manually or physically adjusted so that the light sources are directed to a desired location. The light sources may be fixed and the light from the light source may be moved, bent, directed, or a combination thereof by optical elements, textured portions, micro optics, reflectors (e.g., a light guide), light blades, or a combination thereof. Each individual light of the light source may be turned on and off. For example, in a 10×10 matrix, each of the 100 light sources may be turned on individually. The light sources may be illuminated in a sequence. For example, the light sources may turn on in an order so that the lights appear to move in a direction (e.g., from a center of the vehicle to an edge of the vehicle). The light sources may be turned on in multiple sequences so that the light sources appear to be moving in two or more directions. For example, the light from the light sources may extend in a first direction (e.g., along the z-axis) and a second direction (e.g., along the x-axis or y-axis). The light source may be located within a light system at a location relative to a light guide. Each light guide may receive light from a single light source. The light sources may work together as a set of light sources to create light. The individual lights may be connected to a controller that causes the light sources to work in tandem to provide effects.

The individual lights may be illuminated in a series, a sequence, a design, a pattern, or a combination thereof. The individual lights may be illuminated in a customized manner. The individual lights may be illuminated from a fore to an aft, from an aft to a fore, from a first side to a second side, diagonally, in rows, in columns, in sequence, in a random manner, to form an image, to form a shape, to form a letter, to form a word, or a combination thereof. The lights may be illuminated so that the light system appears to be dancing. The lights may be illuminated so that the lights appear to be moving. The lights may be illuminated so that the light moves in two or more directions. For example, a front surface may be illuminated and a top surface may be illuminated at the same time. The controller may control how the lights are illuminated.

The controller functions to fire the lights in a predetermined sequence. The controller may be programmable. The controller may include predetermined patterns that are selectable. The controller may be part of the vehicle or part of the light system. The controller may include an interface that allows the user to change how the lights are illuminated so that the lights illuminate in two or more directions in a pattern, sequence, or both. The controller controls how and when the light illuminate. The controller may control each individual light individually.

All of the lights within a set of light sources (e.g., a matrix) may provide the same light (e.g., color, color temperature, or wavelength). For example, one set of light sources may be yellow, orange, or red and a second set of light sources may be white (e.g., OEM white, off white, pure white, or crystal white (e.g., having a color temperature between 4300K and 6000K). The lights within a matrix or a light system may provide different colors. For example, some lights may be orange and some lights may be red. The color, intensity, temperature, or a combination thereof may vary from set to set or light to light within a set depending on the function of the set of light sources. For example, if one set of light sources is directed to a turn signal then the color may be orange whereas if the set of light sources is for a brake light then the color may be red. In another example, a day time running light may have various shades of white. The light from the light system may be directed to a predetermined location depending on a function of the light from that set of light sources. For example, a running light may be directed outward in front of a vehicle whereas a turn signal may be directed at a 45 degree angle so that a portion of the light is visible in a front of the vehicle and a portion of the light is visible from a side of the vehicle.

The light from the first light function and the light from the second light function may extend through a lens. The first light function and the second light function may have discrete lenses that are spaced apart. The first light function and the second light function may have mechanically connected lenses. The first light function and the second light function may have optically separated lenses. The first light function and the second light function may each have one or more lenses (e.g., internal lenses).

A light blade may be a lens that permits light to extend into two or more directions. The light blade may extend along an x-axis, along a y-axis, along a z-axis. The light blade may be generally square, rectangular, cubic, a cuboid, a rectangular prism, or a combination thereof. The light blade has an x-direction length along the x-axis, a y-direction length along the y-axis, and a z-direction length along the z-axis. The length in the x-direction and in the y-direction may be greater than the length in the z-direction. The light blade in the z-direction may be substantially planar. The light blade may permit light to extend therethrough in two or more directions. For example, light may extend through the light blade in an x-direction and in a z-direction. The light blade may be substantially clear. The light blade may be covered on one or more sides by a baffle. The baffle may prevent light from extending into the light blade. The baffle may be opaque. The baffle may include recesses that allow light to extend there through into the light guide. The baffle may be located between the light blade and the light sources (e.g., lights) so that light only extends into the light blade in a single direction or through a single surface.

The light blade may have 6 or more surfaces. The light blade may have a top, bottom, left, right, fore, and aft. Light may extend through the light blade in a first light direction and out of the light blade. The light blade may have internal light structures. The internal light structures may be lines within the light blade. The internal light structures may be a microstructure, a surface structure, a lens, or a combination thereof. The internal light structures may disperse light, contain the light so that the light only extends through the internal light structures. The internal light structures may be located on a surface of the light blade. The internal light structures may be located between external walls. The internal light structure may extend from an internal location to an external location. The internal light structures may be parallel lines. The internal light structures may be aligned with lights of the light system. The light may extend out of a first surface of the light blade in a first light direction. The light may extend orthogonal to two surfaces. For example, the light may extend orthogonally relative to and between the top and bottom, left and right, or fore and aft surfaces. The light may extend at an angle relative to a road surface. When the light extends out of the first surface (e.g., top) the light may be projected at an angle that is both upward and outward (e.g., in a fore direction) relative to a road surface. The first surface and the second surface of the light blade may be perpendicular or substantially perpendicular to one other. The angle relative to the road surface may be about 5 degrees or more, about 10 degrees or more, about 15 degrees or more, or about 25 degrees or more. The angle relative to the road surface may be about 90 degrees or less, about 75 degrees or less, about 60 degrees or less, about 45 degrees or less, or about 30 degrees or less. The lights may light up the light blade through the first surface so that the first surface is illuminated in a fore aft direction. The light may extend through the first surface so that the light extends through the top in a fore direction and a z-axis direction. The light may extend at an angle between the z-axis and the road surface to illuminate items forward of the vehicle, provide notice, or both. A plurality of lights from a plurality of light sources may extend through the first surface. A plurality of lights may be visible through the first surface simultaneously. Light may extend through the first surface in rows and columns. The light from the first surface may appear as one solid beam of light. The light from the first surface may extend in a first light direction that is different from light that extends from the second surface in a second light direction.

The second surface may be located adjacent to the first surface. The second surface and the first surface may be right angles relative to one another. The second surface may generally face in a forward direction (or towards the fore of the vehicle). The second surface may be the fore surface. The second surface may be directly opposite an aft surface, a left surface, or a right surface. The second surface may be parallel to an opposing surface. For example, if the second surface is the fore surface then the fore surface is opposite the aft surface, and the fore and aft surface may be generally parallel to one another. The light extending in the second light direction may extend out of the second surface at an angle. The angle may be any angle an such that the second light direction is generally parallel to a driving surface. The second surface (and second light direction) may be angled towards the road surface. The angle relative to the road surface may be about 1 degree or more, about 5 degrees or more, about 10 degrees or more, or about 15 degrees or more. The angle relative to the road surface may be about 90 degrees or less, about 75 degrees or less, about 60 degrees or less, about 45 degrees or less, about 30 degrees or less, or about 20 degrees or less. The angle may an angle such that the light projects outward the one or more lenses and into contact with the road surface.

The one or more lenses function to direct the light from the reflectors to a location to be illuminated. The lenses may function to protect the light emitting portion. The lenses may bend light. The lenses may refract light. The lenses may diffuse the light, blend the light, spread the light, direct the light to a predetermined location, create one or more hot spots, create a homogeneous lighting appearance, prevent hot spots, or a combination thereof. The lens may be located in front of the light emitting portion. The lenses may cover all or a portion of the light system, the light source, light bars, light blade, or a combination thereof. Each light system may include a lens. The light system may include a single lens that covers each of the light bars or light sources that each provide or perform a different function. The lens may cover the light bar or light source so that light, direct light, reflected light, or a combination thereof extends through the lens. The lens may be one or more lenses. The lens may be a plurality of lenses. The lens (e.g., primary lens or internal lens) may be a single lens. The one or more lenses may have a shape that directs light to a predetermined location. The one or more lenses may be flat, planar, bio-convex, plano-convex, positive meniscus, negative meniscus, plano-concave, bio-concave, double convex, converging, diverging, or a combination thereof. Each lens may be a single lens. Each lens may be a compound lens (e.g., there may be more than one lens). Each lens has a forward side (or forward surface) and a rearward side (or rearward surface). The lenses may change a color or wavelength of the light extending through the lens. For example, the light source may generate white light and the white light may be converted into orange light as the light extends through the lens. The lens may include one or more texture portions.

The texture portions function to prevent hot spots, provide a homogenous light pattern, a homogenous amount of light, spread the light, create a location where light exits a light blade or a lens, or a combination thereof. The textured pattern may provide a homogenous lighting appearance when the light is viewed from an external location of a vehicle, an internal location of a vehicle, or both. The texture portion may be added to a lens or a light blade (a light blade as discussed herein may be a type of lens). For example, a texture may be sprayed on the lens, etched into the lens, mechanically added, mechanically formed, or a combination thereof. The textured portions may be on an external surface, an internal surface, a location between the internal surface and the external surface, or a combination thereof. The texture portions may be formed while the lenses are being formed. Some lenses may include a texture portion on or in an external surface and an internal surface. The texture portions on opposing surfaces may extend in a substantially parallel direction, in a direction complementary to a shape of the lens, or both. A texture portion may located within or along two or more axis of the lens (e.g., light blade). The lenses may be free of texture portions. The texture portion may have a shape that is a pyramid, half circle, square, rectangle, zig zag patterns, lines, cylindrical, tetrahedron, cube, hexagonal, icosahedron, a prism, a pentagonal pyramid, a cone, cuboid, a symmetrical shape, an asymmetrical shape, a geometric shape, a non-geometric shape, or a combination thereof. The textured portion may form an outer surface or a lens. The textured portion may extend substantially a length, a width, or both of the lens. For example, the textured portion may terminate at a texture shutoff such that the textured portion does not extend the length and/or width of the lens. The textured portion may be the only portion of the lens that light extends through. For example, the textured portion may interrupt a portion of the lens so that the light extends out of the lens. The textured portion may be free of hot spots. The textured portion may be free of contact with a blocker. The textured portion of a lens may stop before a blocker. A portion of the blocker may extend behind the textured portion but may be free of contact. A blocker may prevent light from extending through a region The textured portion may terminate at a texture shutoff. A texture shutoff may be a termination of a texture where light is prevented from extending out of the lens. The light blade may be located within a housing such that light extending through the light blade extends through the light blade into two or more predetermined regions and out of the light blade whether the light blade includes textured portions or is free of textured portions.

The housing functions to connect the light system and/or bi-directional light system within a vehicle, retain a light blade within a vehicle, hold the light blade in a predetermined position, support two or more light sources relative to the light blade, support two or more printed circuit boards relative to the light blade, or a combination thereof. The housing may be made of or include metal, plastic, a polymer, a polycarbonate, or a combination thereof. The housing may be substantially rigid, have flexible regions, movable regions, or a combination thereof. The housing may be receive one or more fasteners or a plurality of fasteners. All of the parts of the bi-directional light system may be connectable to the housing and then the bi-directional light system be installed into a vehicle by installing the housing into the vehicle. The housing may include walls such that the housing forms a box. The housing may include a bottom wall, first side wall, second side wall, fore wall, aft wall, or a combination thereof. The housing may be free of a top wall so that the top of the housing is open. Some or most of the components may be connected to the housing through a top of the housing so that a stack up may be formed in an internal location of the housing. The housing may include one or more board supports.

The board supports function to support one or more printed circuit boards within the housing, relative to a light blade, or both. The board support may extend upward from a base of the housing. The board support may be connected to a base of the housing via one or more fasteners. The board support may extend substantially in the z-direction (e.g., at an angle of between about 1 degrees and 15 degrees or 5 degrees to 10 degrees relative to the z-axis). The board support may extend along the z-axis and the x-axis. The board support may be tilted towards the light blade in the x-axis direction to form the angle. The board support may connect to one or more printed circuit boards (PCBs). The PCBs are aligned with a surface of the light blade by the board support aligning the PCBs with the light blade. The PCBs may include one or more light sources. The PCBs may include a plurality of light sources. The PCBs may be a single PCB, one or more PCBs, or two or more PCBs. The board support may be connected to one or more PCBs that include one or more light sources so that light from the light source extends through a window in a light guide and into the light blade.

The light guide functions to permit some light to extend into the light blade and to prevent some light from extending into the light blade. The light guide may be part of a support. The light guide may be made of the same material as the support discussed herein. The light guide may be opaque. The light guide may align with PCBs, light sources, or both. The light guide may include one or more windows.

The window functions to permit some light to extend into the light blade in a predetermined region and prevent light from extending into the light blade in surrounding regions (e.g., regions where light is not desired). The window may be an absence of material. The window may be a transparent portion. The window may be aligned with the light sources, the board support, the PCBs, or a combination thereof. The window may have an axis so that light directed through the window is aligned with the light blade. The window may have an axis that extends parallel to the aft side and the fore side of the light blade so that light extending in the first light direction extends directly through the light blade at the angle discussed herein. The window may be an opening in a solid surface of the housing. The window may be one continuous opening. The window may be a plurality of openings. The window may create rows or columns of light that extends through the light blade. The window may direct a first light in a first light direction so that the first light is free of an intersection with a second light that extends in a second light direction. The first light may extend through the light blade and intersect with and pass through the second light. The window may be one or more windows, two or more windows, three or more windows, four or more windows, or five or more windows. The window may be 20 or less windows, 15 or les windows, or 10 or less windows. The window may have a same number of windows as light sources located on the printed circuit board so that light from each light source extends through its own window. The windows may be square, rectangular, circular, oval, triangular, or a combination thereof. The windows may direct light in a direction that is substantially parallel to a baffle that is located proximate to a different light or second light.

The baffle functions to prevent some light to extend from light sources into a light blade and allow some light from the light sources to extend into the light blade. The baffle may be part of the housing. The baffle may be a discrete part that is connected to the hosing. The baffle may be connected to the hosing via one or more fasteners. The baffle may be made of the same material as the housing. The baffle may be opaque. The baffle may extend in a plane parallel to the PCBs. The baffle may be located between the PCBs and light sources and the light blade. The baffle may control an amount of light directed into the light blade, locations of light into the light blade, or both. The baffle may direct light in rows and columns. The baffle may include one or more recesses that permit light to extend through the baffle into the light blade.

The recesses function to permit light to extend through baffle in predetermined locations. The recesses may be an absence of material, an aperture, a hole, a through hole, a transparent region, or a combination thereof. The recesses may be square, rectangular, oval, circular, triangular, aligned with a row of light sources, aligned with a column or light sources, aligned with a single light source, or a combination thereof. The recesses may direct light into the light blade in a region that is different than a region where light extends through the light blade in the first light direction. Light extending through the recesses may be free of intersection with the light from the light window. The baffle may include one or more recesses, two or more recesses, three or more recesses, four or more recesses, six or more recesses, eight or more recesses, or ten or more recesses. The baffle may include 50 or less recesses, 40 or less recesses, 30 or less recesses, or 20 or less recesses. The baffle may include a number of rows or columns and the number of rows or columns may be equal to a number of rows or columns of light sources located proximate to the baffle (e.g., second light sources). The number of recesses may match a number of light sources. A length of the recesses may extend in or along a fore/aft direction. The recesses may direct light in a direction orthogonal to the light blade. The recesses may be aligned in a direction so that the recesses direct the second light through the light blade in an angle discussed herein. The recesses may extend in a z-direction through the baffle so that light may extend in the z-direction. The baffle may be connected to a support.

The support functions to support the PCBs and the baffle relative to one another. The support functions to align the baffle, the recesses of the baffle, the PCBs, the second light sources on the PCBs, or a combination thereof relative to one another. The support may provide spacing between the baffle and the PCBs. The support may enclose light so that any light from the light sources extends entirely within the support. The support may be located below the baffle and the PCBs may hang below the support. The support may be part of the housing or made of the same material as the housing. The support may be opaque. The support may form a box with a partially or fully open top and a partially or fully open bottom. The support may have openings that align with the recesses in the baffle. The baffle may form a top of the support. The baffle may extend within the support so that light extends through an interior of the support and then through the baffle. The support may be located on an interior of the housing. The support may include one or more gaps that extend through an interior of the housing.

The gaps function to permit light to extend from the light sources into the light blade. The gaps may align with recess in the baffle. The gaps may be through holes in the support. The support may be substantially solid and may include gaps that extend therethrough. The gaps may be larger than the recesses in the baffle. The gaps may direct a first amount of light towards the light blade. The first amount of light may be reduces by the baffle so that a second amount of light extends through the recesses into the light blade. The gaps may be substantially a same shape or number as the recesses. The support may be suspended below the light guide by fasteners.

The fasteners function to connect portions of the bi-directional light system, the light system, or a both to a housing. The fasteners may be removable. The fasteners may be permanent. The fasteners may be threaded. The fasteners may be a weld, an adhesive, a threaded member, a push pin, a Christmas tree, a nut and screw, a nut and bolt, or a combination thereof.

FIG. 1A illustrates a side view of a vehicle 2 including light systems 10. The light systems 10 includes a bi-directional light system 12 in a front of the vehicle 2 and a turn signal 28. The bi-directional light system 12 includes a head light and/or a daytime running light 24. The headlight and/or daytime running light 24 provides light in a first light direction 22 and a second light direction 26. The vehicle 2 includes a controller 8 that controls the light systems 10.

Figure 1B:
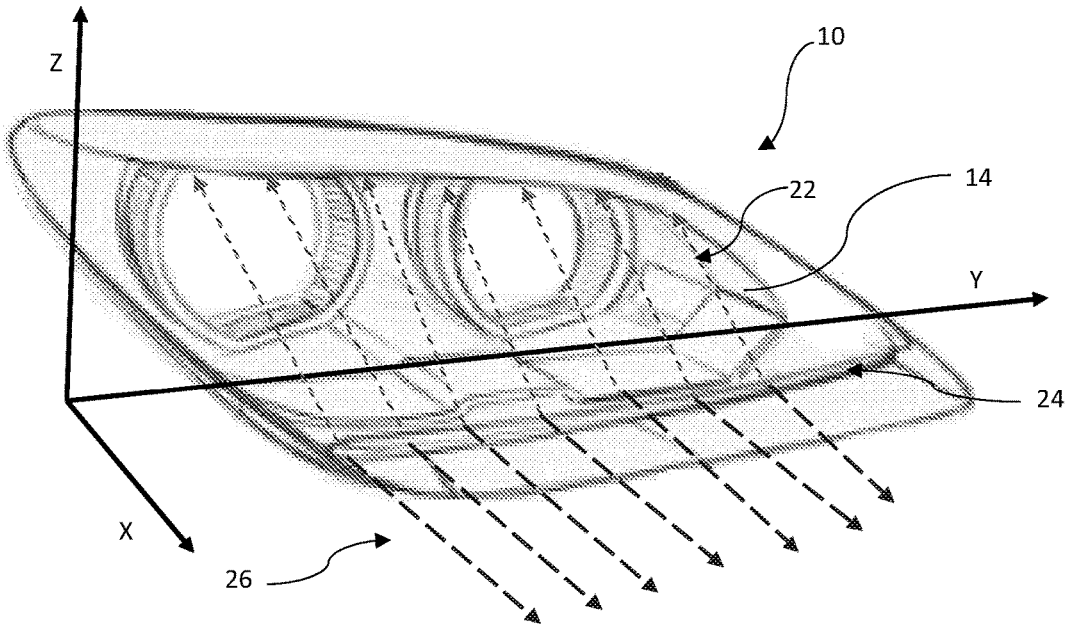
FIG. 1B is a close-up view of a light system

FIG. 1B is an isometric view of the light system 10. The light system 10 includes an outer lens 14. Light from the headlight/daytime running light 24 provides light in a first light direction 22 through the outer lens 14 in substantially the Z-direction so that the light of the first light direction 22 extends in an upward fore/aft direction. A second light direction 26 is provided from the headlight/daytime running light 24 through the outer lens 14 in substantially the x-direction so that light of the second light direction 26 extends out of the vehicle 10.

Figure 2A:
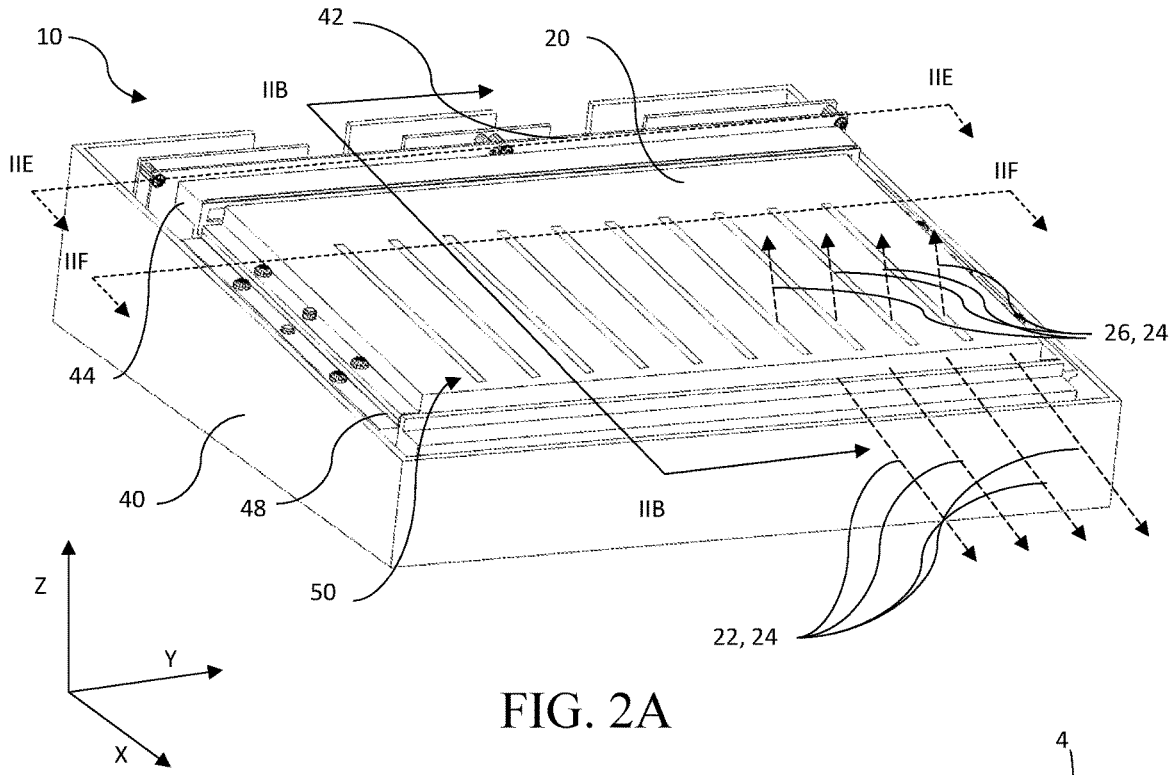
FIG. 2A is a front isometric view of a light system.

FIG. 2A is an isometric view of a light system 10. As shown, the light system 10 is a bi-directional light system 12 with a light blade 20 that guides light from the headlight/daytime running lights 24 in a first light direction 22 and a second light direction 26. The light system 10 has a housing 40 with a first printed circuit board 42 extending in the z-direction to direct light through the light blade 20 to provide the first light direction 22. The first printed circuit board 42 includes a plurality of light sources (not shown) that provide light through a light guide 44 that directs light into the light blade 20 that result in the first light direction 22. A baffle 46 is located below the light blade 20. The baffle 48 includes a plurality of recesses 50 that guide light from light sources on a second printed circuit board (not shown) into the light blade 20 to provide the second light direction 26.

Figure 2B:
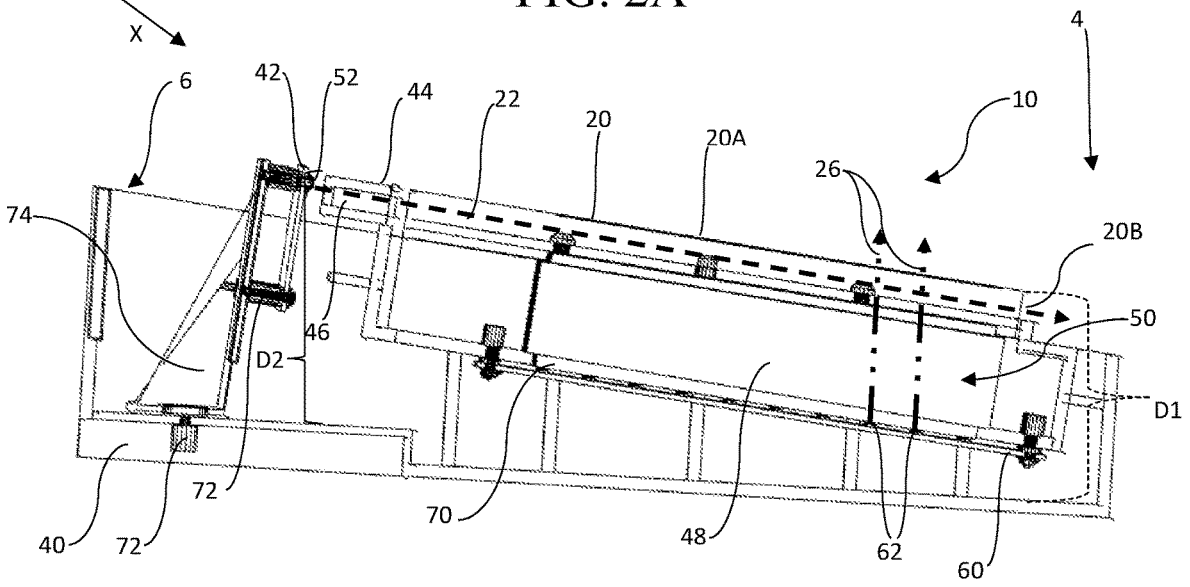
FIG. 2B is a side cross-sectional view of FIG. 2A along lines IIB-IIB.

FIG. 2B is a cross-sectional side view of the light system 10 of FIG. 2A along lines IIB-IIB. The light system 10 includes ends that include a fore 4 and an aft 6. The light system 10 includes a housing 40. The housing in connected to a board support 74 via fasteners 72. The board support 74 is connected to a printed circuit board 42 via fasteners 72. The printed circuit board 42 is connected to a plurality of first light sources 52. The plurality of light sources 52 direct a first light having a first light direction 22 through a window 46 in a light guide 44 into the light blade 20. Additionally, the housing 40 is connected to a support 70. The support 70 is connected to a second printed circuit board 60 via fasteners 72. The second printed circuit board 60 includes a plurality of second light sources 62. The plurality of second light sources 62 project light having a second light direction 26 into recesses 50 of the baffle 48 so that the light providing the second light direction 62 is provided through the light blade 20. The light blade 20 includes a first surface 20A that the first light direction 22 passes through and a second surface 20B that the second light direction 26 passes through. The light blade 20 extends at an angle such that at the for end 4 the light blade is located a distance D1 from the housing 40 and at the aft end 6 the light blade is located a distance D2 from the housing 40. The distance D1 is less than the distance D2.

Figure 2C:
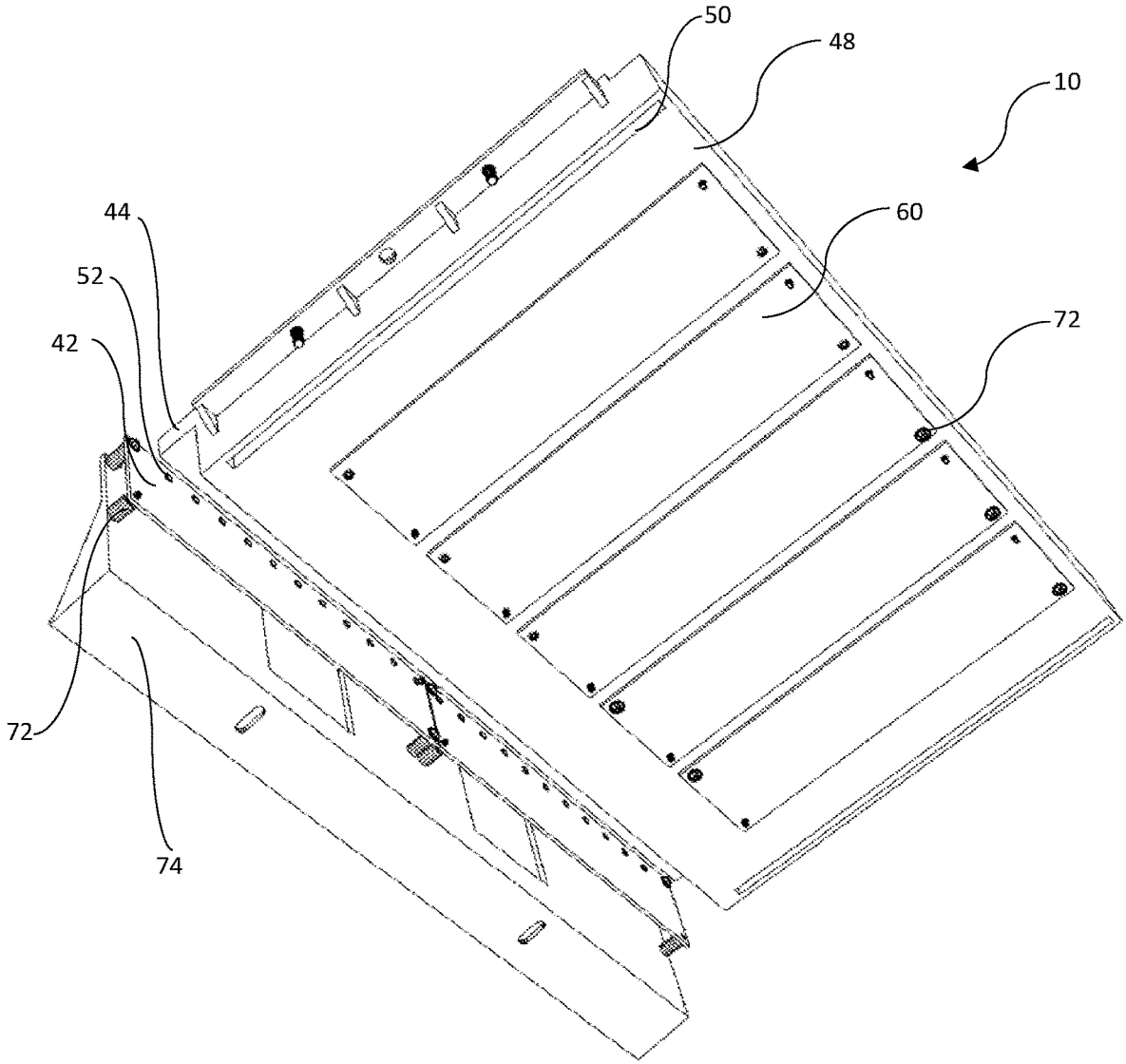
FIG. 2C is bottom view of the light system with the housing removed.

FIG. 2C is a bottom plan view of the light system 10 with the housing removed to expose the second printed circuit boards 60. The printed circuit boards 60 are connected to a baffle 48 via a plurality of fasteners 72. The baffle 48 includes recesses 50 that light extends though. Adjacent the plurality of second printed circuit boards 60 is a board support 74 that supports a first printed circuit board 42 via fasteners 72. The first printed circuit board 42 includes a plurality of first light sources 52.

Figure 2D:
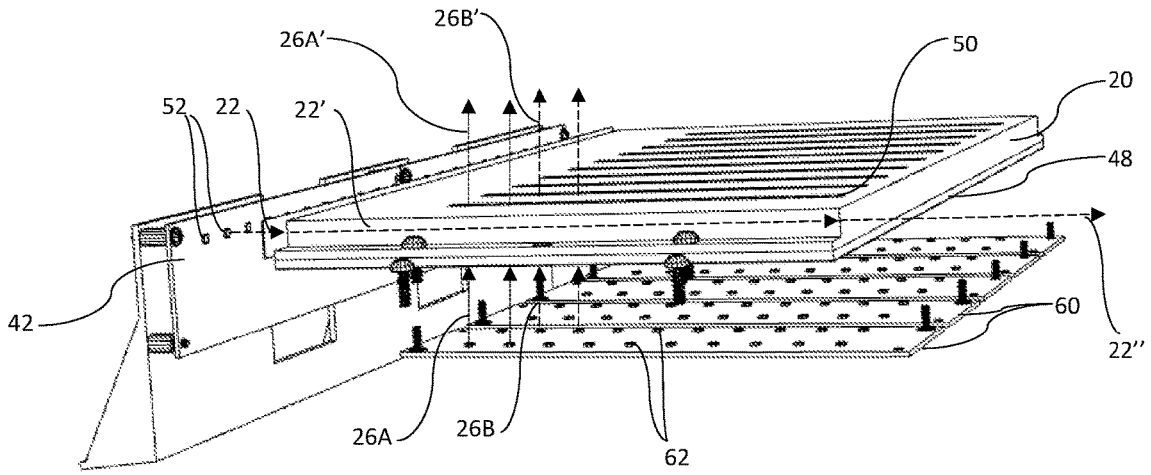
FIG. 2D is a side view of the light system with the housing removed.

FIG. 2D illustrates a first printed circuit board 42 comprising a plurality of first light sources 52. The first light sources 52 provide light with a first light direction 22. As shown, the first light direction 22 extends from the first light sources 52 into the light blade 20 as a first light direction 22' and then out of the light blade 20 as a first light direction 22". A plurality of second printed circuit boards 60 each comprise a plurality of second light sources 62. The plurality of light sources 62 are located in rows so that a first row produces a second light direction 26A through a recess 50 in a baffle 48 and exit the light blade 20 as a second light direction 26A'. A second row of the plurality of light sources 62 provides a second light direction 26B through a recess 50 in a baffle 48 and exit the light blade 20 as a second light direction 26B'.

Figure 2E:
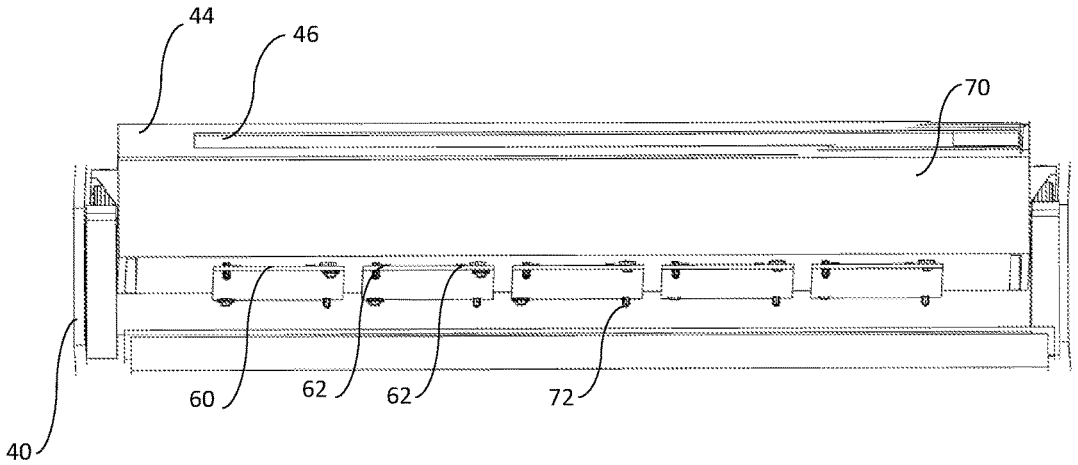
FIG. 2E is a cross-sectional view of FIG. 2A along lines IIE-IIE.

FIG. 2E is a cross-sectional view of FIG. 2A along lines IIE-IIE. As shown, the housing 40 includes a support 70 that is connected to second printed circuit boards 60 include second light sources 62. The second printed circuit boards 60 are connected to the support 70 by fasteners 72. The support 70 includes a light guide 44 including a window 46 that the first light extends through.

Figure 2F:
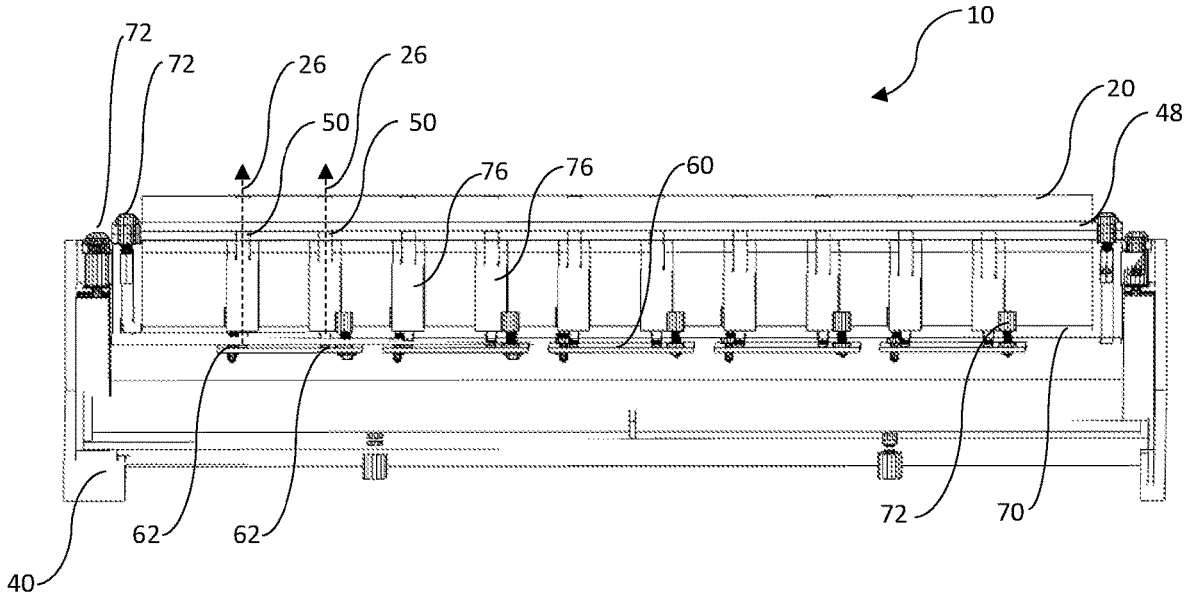
FIG. 2F is a cross-sectional view of FIG. 2A along lines IIF-IIF.

FIG. 2F is a cross-sectional view of FIG. 2A along lines IIF-IIF. The light system 10 includes a housing 40 forming an outside. The housing 40 is connected to a support 70 via fasteners 70. Above the support 70 is a baffle 48 and then a light blade 20. A bottom side of the support 70 comprises a plurality of second printed circuit boards 60 that each include a plurality of second light sources 62. The secondary light sources 62 direct light between gaps 76 in the supports 70 and through recesses 50 within the baffle 48 so that a second light direction 26 is visible through the light blade 20.

Any numerical values recited herein include all values from the lower value to the upper value in increments of one unit provided that there is a separation of at least 2 units between any lower value and any higher value. As an example, if it is stated that the amount of a component or a value of a process variable such as, for example, temperature, pressure, time and the like is, for example, from 1 to 90, preferably from 20 to 80, more preferably from 30 to 70, it is intended that values such as 15 to 85, 22 to 68, 43 to 51, 30 to 32 etc. are expressly enumerated in this specification. For values which are less than one, one unit is considered to be 0.0001, 0.001, 0.01 or 0.1 as appropriate. These are only examples of what is specifically intended and all possible combinations of numerical values between the lowest value and the highest value enumerated are to be considered to be expressly stated in this application in a similar manner.

Unless otherwise stated, all ranges include both endpoints and all numbers between the endpoints. The use of "about" or "approximately" in connection with a range applies to both ends of the range. Thus, "about 20 to 30" is intended to cover "about 20 to about 30", inclusive of at least the specified endpoints.

The disclosures of all articles and references, including patent applications and publications, are incorporated by reference for all purposes. The term "consisting essentially of" to describe a combination shall include the elements, ingredients, components or steps identified, and such other elements ingredients, components or steps that do not materially affect the basic and novel characteristics of the combination. The use of the terms "comprising" or "including" to describe combinations of elements, ingredients, components or steps herein also contemplates embodiments that consist essentially of or even consists of the elements, ingredients, components or steps.

Plural elements, ingredients, components or steps can be provided by a single integrated element, ingredient, component or step. Alternatively, a single integrated element, ingredient, component or step might be divided into separate plural elements, ingredients, components or steps. The disclosure of "a" or "one" to describe an element, ingredient, component or step is not intended to foreclose additional elements, ingredients, components or steps.

It is understood that the above description is intended to be illustrative and not restrictive. Many embodiments as well as many applications besides the examples provided will be apparent to those of skill in the art upon reading the above description. The scope of the invention should, therefore, be determined not with reference to the above description, but should instead be determined with reference to the appended claims, along with the full scope of equivalents to which such claims are entitled. The disclosures of all articles and references, including patent applications and publications, are incorporated by reference for all purposes. The omission in the following claims of any aspect of subject matter that is disclosed herein is not a disclaimer of such subject matter, nor should it be regarded that the inventors did not consider such subject matter to be part of the disclosed inventive subject matter.

ELEMENT LIST

2 vehicle
4 Fore
6 Aft
8 Controller
10 Light System
12 Bi-directional light system
14 Outer lens
20 Light Blade
20A First Surface
20B Second Surface
22 First light direction
24 Headlight/daytime running light.
26 Second light direction
28 Turn signal
40 Housing
42 First printed circuit board
44 Light guide
46 Window
48 Baffle
50 Recess
52 First light sources
60 Second printed circuit board
62 Second light sources
70 Support
72 Fastener
74 Board Support
76 Gap

We claim:

1. A light system comprising:
a light blade comprising:
a first surface and
a second surface that is substantially perpendicular to the first light surface;
a bi-directional light system comprising:
first light sources configured to direct first lights into the light blade so that the first lights extend out of the first surface of the light blade to generate a first lighting function in a first light direction generally upwards along a z-axis and above the light system, and
second light sources configured to direct second lights into the light blade so that the second lights extend out of the second surface of the light blade to generate a second lighting function in a second light direction generally forward along an x-axis; and
wherein the first lighting function is different from the second lighting function.

2. The light system of claim 1, wherein a baffle is located between the light blade and the second light sources.

3. The light system of claim 2, wherein the baffle includes recesses that allow the second lights to extend from the second light sources through the baffle and into the light blade.

4. The light system of claim 3, wherein the recesses are configured to extend in a direction between a fore and an aft of the vehicle housing the light system.

5. The light system of claim 1, wherein the second lights originate, or are provided by, a plurality of the second light sources and the light system includes a plurality of second printed circuit boards and each of the plurality of second printed circuit boards include some of the plurality of the second light sources.

6. The light system of claim 1, wherein a support extends between the light blade and the second light sources so that the second lights extend from the second light sources through the support and into the light blade.

7. The light system of claim 6, wherein the support includes a light guide.

8. The light system of claim 7, wherein the light guide comprises one or more windows that allow the first light to extend from the first light sources through the one or more windows and into the light blade.

9. The light system of claim 1, wherein the first lights and the second lights are a daytime running light.

10. The light system of claim 1, wherein first light sources are located on one or more first printed circuit boards.

11. The light system of claim 10, wherein the one or more first printed circuit boards are connected to a board support.

12. The light system of claim 1, wherein one or more baffles are located below the light blade and above a support.

13. The light system of claim 12, the support includes a plurality of supports and the plurality of supports are located such that gaps are located between each of the plurality of supports and the gaps align with recesses in the one or more baffles.

14. The light system of claim 1, wherein the light blade includes an a fore and an aft and the light blade at the aft is further from a housing containing the light system then the light blade at the fore.

15. The light system of claim 1, wherein the light system comprises an outer lens.

16. The light system of claim 1, wherein the second light sources extend in rows and columns so that the second light sources, producing the second lights, form a matrix.

17. The light system of claim 1, wherein the light blade is free of any textures or surface textures, and wherein the first lights and the second lights extend directly through the light blade without substantially any reflection, refraction, bending, or a combination thereof caused by the light blade.

18. A light system comprising:

a daytime running light;

a controller and a light blade comprising:

a first surface and a second surface;

a bi-directional light system configured to direct first lights into the light blade so that the first lights extend out of the first surface of the light blade to generate a first light function in a first light direction, and the bi-directional light system is configured to direct second lights into the light blade so that the second lights extend out of the second surface of the light blade to generate a second light function in a second light direction that is forward relative to a direction of movement of a vehicle configured to house the light system; and wherein the first surface and the second surface are adjacent;

wherein the controller controls the bi-directional light system to illuminate individual lights of the bi-directional light system through the light blade upwards along a z-axis so that the first lights extending in the first light direction turns on and off in a sequence so that the first lights appear to move relative to the first surface in the first light direction; and wherein the second light direction extends through the second surface to form the daytime running light.

19. The light system of claim 18, wherein the bi-directional light system comprises:

first light sources that direct the first lights in the first light direction and second light sources that direct the second lights in the second light direction;

wherein a baffle is located between the light blade and the second light sources and the baffle includes recesses that allow the second lights to extend from the second light sources through the baffle and into the light blade.

20. The light system of claim 19, wherein the second light sources extend in rows and columns so that the second light sources, producing the second lights, form a matrix.

* * * * *